US007650097B2

(12) United States Patent
Yoon et al.

(10) Patent No.: US 7,650,097 B2
(45) Date of Patent: Jan. 19, 2010

(54) SLIDE SHUTTER AND TONER SUPPLYING APPARATUS HAVING THE SAME

(75) Inventors: Hyung-won Yoon, Seongnam-si (KR); Jong-pil Jun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 328 days.

(21) Appl. No.: 11/774,708

(22) Filed: Jul. 9, 2007

(65) Prior Publication Data

US 2008/0019730 A1 Jan. 24, 2008

(30) Foreign Application Priority Data

Jul. 20, 2006 (KR) ..... 10-2006-0068155

(51) Int. Cl.
*G03G 15/08* (2006.01)

(52) U.S. Cl. ..... 399/106; 399/260; 399/262

(58) Field of Classification Search ..... 399/258, 399/260, 262, 263, 106
See application file for complete search history.

(56) References Cited

U.S. PATENT DOCUMENTS

| | | | | |
|---|---|---|---|---|
| 4,937,625 | A * | 6/1990 | Kato et al. | 399/258 |
| 5,867,757 | A * | 2/1999 | Okazaki et al. | 399/262 |
| 5,890,040 | A * | 3/1999 | Matsuoka et al. | 399/262 |
| 5,966,574 | A * | 10/1999 | Ui et al. | 399/258 |
| 6,137,972 | A * | 10/2000 | Playfair et al. | 399/106 |
| 6,298,208 | B1 * | 10/2001 | Kawamura et al. | 399/262 |
| 7,245,852 | B2 * | 7/2007 | Takuwa | 399/258 |
| 7,391,999 | B2 * | 6/2008 | Yamada | 399/262 |
| 2003/0063927 | A1 * | 4/2003 | Wang et al. | 399/263 |
| 2005/0041999 | A1 | 2/2005 | Sudo et al. | |
| 2005/0207796 | A1 | 9/2005 | Ishiguro et al. | |
| 2006/0034641 | A1 * | 2/2006 | Yamada et al. | 399/258 |
| 2007/0140707 | A1 * | 6/2007 | Kaiho | 399/258 |
| 2007/0140746 | A1 * | 6/2007 | Kaiho | 399/262 |
| 2009/0003886 | A1 * | 1/2009 | Takuwa | 399/262 |

FOREIGN PATENT DOCUMENTS

| | | |
|---|---|---|
| EP | 1548518 | 6/2005 |
| JP | 62294271 A * | 12/1987 |
| JP | 2003195632 | 7/2003 |
| JP | 2005077783 | 3/2005 |
| KR | 2005-65397 | 6/2005 |

OTHER PUBLICATIONS

European Search Report issued May 15, 2009 in EP Application No. 07112338.4.
European Search Report issued Jun. 26, 2009 in EP Application No. 09161416.4.
Korean Office Action dated Apr. 29, 2008 issued in KR 2006-0068155.

* cited by examiner

*Primary Examiner*—Susan S Lee
(74) *Attorney, Agent, or Firm*—Stanzione & Kim LLP

(57) ABSTRACT

A toner supplying apparatus having a sealing member. The toner supplying apparatus includes a toner tank to hold toner, the toner tank having a toner supplying hole to discharge the toner, a slide shutter disposed inside the toner tank so as to close the toner supplying hole, the slide shutter allowing the toner supplying hole to be opened when the toner tank is mounted in an image forming apparatus, and a sealing member disposed on an outer circumference of the slide shutter to prevent the toner from leaking out through a gap between the slide shutter and the toner tank.

14 Claims, 3 Drawing Sheets

SLIDE SHUTTER AND TONER SUPPLYING APPARATUS HAVING THE SAME

CROSS-REFERENCE TO RELATED APPLICATIONS

This application claims priority under 35 U.S.C. §119 (a) from Korean Patent Application No. 10-2006-0068155, filed on Jul. 20, 2006, in the Korean Intellectual Property Office, the disclosure of which is incorporated herein by reference in its entirety.

BACKGROUND OF THE INVENTION

1. Field of the Invention

The present general inventive concept relates to an image forming apparatus. More particularly, the present general inventive concept relates to a toner supplying apparatus to supply an image forming apparatus with toner.

2. Description of the Related Art

Generally, when a separate toner supplying apparatus usable in an image forming apparatus is mounted to a predetermined position on the image forming apparatus, toner is supplied from the toner supplying apparatus to a developing unit of the image forming apparatus.

FIG. 1 is a view illustrating a conventional toner supplying apparatus used in an image forming apparatus.

In FIG. 1, a supplying part 11 of a toner supplying apparatus 1 is mounted in a fixing part 5 of an image forming apparatus 3. The toner supplying apparatus 1 includes a toner tank 10 and the supplying part 11 which is formed at one side of the toner tank 10. The supplying part 11 is formed in a substantially hollow cylindrical shape and a toner supplying hole 13 for discharging toner is provided on an outer circumference of the supplying part 11. A slide shutter 15 is formed in a substantially hollow cylindrical shape and has an outer diameter corresponding to an inner diameter of the supplying part 11 so the slide shutter 15 can slide relative to the supplying part 11. A toner outlet 17 facing the toner supplying hole 13 of the supplying part 11 is formed at the slide shutter 15. Accordingly, if the slide shutter 15 is slidingly moved to one side and the toner outlet 17 is aligned with the toner supplying hole 13, toner in the toner tank 10 may flow through the toner outlet 17 to the toner supplying hole 13, and if a body of the slide shutter 15 closes the toner supplying hole 13, discharge of the toner may be blocked. The fixing part 5 of the image forming apparatus 3 is molded in a substantially hollow cylindrical shape, and includes an operating projection 7 to operate the slide shutter 15 of the toner supplying apparatus 1. Additionally, a toner inlet 9 facing the toner supplying hole 13 of the toner supplying apparatus 1 is mounted on a lower side of the fixing part 5. Accordingly, if the supplying part 11 of the toner supplying apparatus 1 is mounted in the fixing part 5 of the image forming apparatus 3, the toner supplying hole 13 of the toner supplying apparatus 1 may face the toner inlet 9 of the image forming apparatus 3. At this time, the slide shutter 15 is slid to one side by the opening projection 7 of the fixing part 5, so the toner outlet 17 of the slide shutter 15 may also face the toner supplying hole 13. Therefore, the toner outlet 17, toner supplying hole 13, and toner inlet 9 are in fluid communication with each other, and thus the toner in the toner tank 10 may be supplied to the image forming apparatus 3 by the slide shutter 15.

When the toner in the toner tank 10 runs out, the toner supplying apparatus 1 is separated from the fixing part 5 to fill the toner tank 10 with new toner. The slide shutter 15 is slid in a reverse direction by a return spring (not illustrated) to block the toner supplying hole 13.

The slide shutter 15 is formed of an injection molding product, and there is a need for a regular gap between the outer surface of the slide shutter 15 and the inner surface of the supplying part 11 so that the slide shutter 15 can slide relative to the supplying part 11 of the toner tank 10. However, since toner particles are very fine, the toner may flow out of the toner tank 10 through the gap between the slide shutter 15 and the supplying part 11, and the toner supplying hole 13. In other words, the slide shutter 15 does not sufficiently seal the toner tank 10 to prevent leakage of the stored toner.

Additionally, if the toner is attached to the outer circumference of the slide shutter 15, it is impossible for the slide shutter 15 to easily slide along the inner surface of the supplying part 11. In this situation, when the toner supplying apparatus 1 is separated from the image forming apparatus 3, the slide shutter 15 cannot move, and as a result separation can only be performed when the toner supplying hole 13 is opened. Accordingly, toner remaining in the toner tank 10 flows out and contaminates the environment.

SUMMARY OF THE INVENTION

The present general inventive concept provides a toner tank, a slide shutter, a sealing member, an elastic member, and a toner supplying apparatus having the same capable of being operated without leakage of toner when the toner supplying apparatus is mounted in or separated from an image forming apparatus.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a toner supplying apparatus including a toner tank to hold toner, the toner tank having a toner supplying hole to discharge the toner, a slide shutter disposed inside the toner tank so as to close the toner supplying hole, the slide shutter allowing the toner supplying hole to be opened when the toner tank is mounted in an image forming apparatus, and a sealing member disposed on an outer circumference of the slide shutter to prevent the toner from leaking out through a gap between the slide shutter and the toner tank.

The toner supplying apparatus may further include a supplying part formed in a substantially cylindrical shape to guide movement of the slide shutter, and an elastic member to elastically support the slide shutter.

The slide shutter may include a body part formed in a substantially hollow cylindrical shape, the body part comprising a toner outlet, and a front circular plate and a rear circular plate disposed at both ends of the body part, the front and rear circular plates having outer diameters corresponding to an inner diameter of the supplying part. The slide shutter may further include a guide part disposed on an outer circumference of the body part.

The foregoing and/or other aspects and utilities of the present general inventive concept may also be achieved by providing a toner supplying apparatus including a toner tank to hold toner, the toner tank having a toner supplying hole to discharge the toner, a supplying part formed inside the toner tank in a substantially hollow cylindrical shape to separate the toner supplying hole from the toner tank in which the toner is stored, a slide shutter disposed inside the supplying part to close the toner supplying hole, the slide shutter allowing the toner supplying hole to be opened when the toner tank is mounted in an image forming apparatus, an elastic member to elastically support the slide shutter so that the slide shutter returns to an original position to seal the toner supplying hole when the toner tank is separated from the image forming apparatus, a toner conveying member extending from the inside of the toner tank to the inside of the slide shutter to convey the toner stored in the toner tank to the toner supplying hole, and a sealing member disposed on an outer circumference of the slide shutter to prevent the toner from leaking out through a gap between the slide shutter and the supplying part.

The foregoing and/or other aspects and utilities of the present general inventive concept may also be achieved by providing a toner tank of a toner supplying apparatus detachably mounted in an image forming apparatus to supply toner, the toner tank including a supplying part to guide a slide shutter having a sealing member on an outer circumference thereof to slide along an inside surface of the supplying part, and a toner supplying hole formed in the supplying part to discharge toner stored in the toner tank. The sealing member of the slide shutter may seal the toner supplying hole when the toner supplying apparatus is separated from the image forming apparatus.

An elastic member to elastically support the slide shutter may be disposed in the toner tank.

The foregoing and/or other aspects and utilities of the present general inventive concept may also be achieved by providing a slide shutter of a toner supplying apparatus detachably mounted in an image forming apparatus to supply toner, wherein: the toner supplying apparatus having a supplying part in which a toner supplying hole to discharge toner is formed, the slide shutter comprises a body part formed in a substantially hollow cylindrical shape, the body part comprising a toner outlet, and a front circular plate and a rear circular plate disposed at both ends of the body part, the front and rear circular plates having outer diameters corresponding to an inner diameter of the supplying part, and the toner outlet faces the toner supplying hole of the supplying part when the toner supplying apparatus is mounted in the image forming apparatus.

A sealing member may be disposed on the body part to prevent the toner from leaking out through a gap between the slide shutter and the supplying part.

The slide shutter may be elastically supported by an elastic member disposed inside the supplying part, and may further include a guide part disposed on an outer circumference of the body part.

The foregoing and/or other aspects and utilities of the present general inventive concept may also be achieved by providing a sealing member of a toner supplying apparatus detachably mounted in an image forming apparatus to supply toner, wherein the toner supplying apparatus comprises a supplying part in which a toner supplying hole to discharge toner is formed, and the sealing member, disposed on an outer circumference of a slide shutter to slide inside the supplying part, to allow the toner of the toner supplying apparatus to be discharged to the image forming apparatus when a toner outlet of the slide shutter faces the toner supplying hole, and to prevent the toner from leaking out through a gap between the supplying part and the slide shutter when the toner outlet of the slide shutter deviates from the toner supplying hole.

The foregoing and/or other aspects and utilities of the present general inventive concept may also be achieved by providing an elastic member of a toner supplying apparatus detachably mounted in an image forming apparatus to supply toner, wherein the toner supplying apparatus comprises a supplying part in which a toner supplying hole to discharge toner is formed, and the elastic member, disposed inside the supplying part to elastically support a slide shutter, to enable a toner outlet of the slide shutter to face the toner supplying hole when the toner supplying apparatus is mounted in the image forming apparatus, and to enable a sealing member disposed on an outer circumference of the slide shutter to seal the toner supplying hole when the toner supplying apparatus is separated from the image forming apparatus.

BRIEF DESCRIPTION OF THE DRAWINGS

These and/or other aspects and utilities of the present general inventive concept will be more apparent and more readily appreciated from the following description of the embodiments, taken in conjunction with the accompanying drawings of which.

DETAILED DESCRIPTION OF THE PREFERRED EMBODIMENTS

Figure 1:
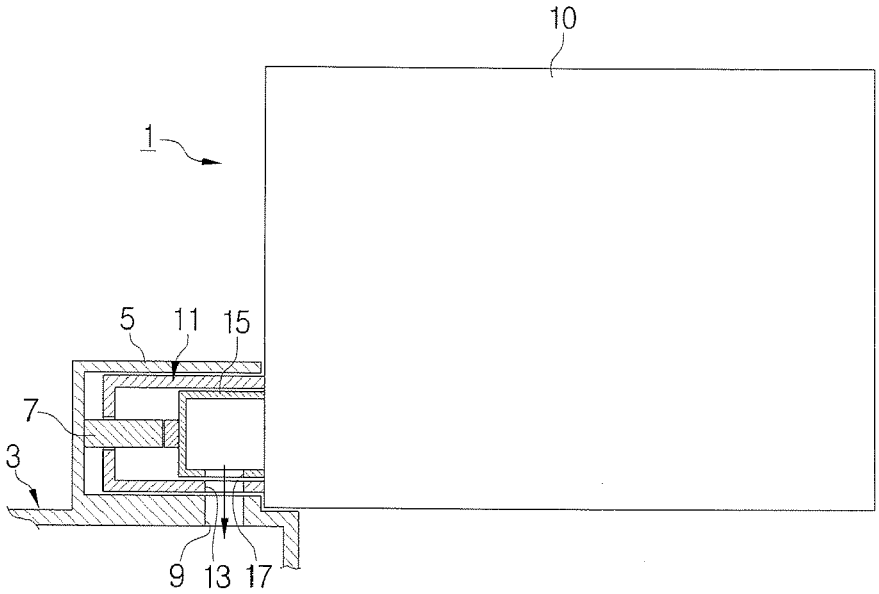
FIG. 1 (PRIOR ART)
FIG. 1 is a partial sectional view illustrating a conventional toner supplying apparatus used in an image forming apparatus.

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

Hereinafter, a toner supplying apparatus according to an exemplary embodiment of the present general inventive concept will be described in detail with reference to FIGS. 2 to 4.

Figure 2:
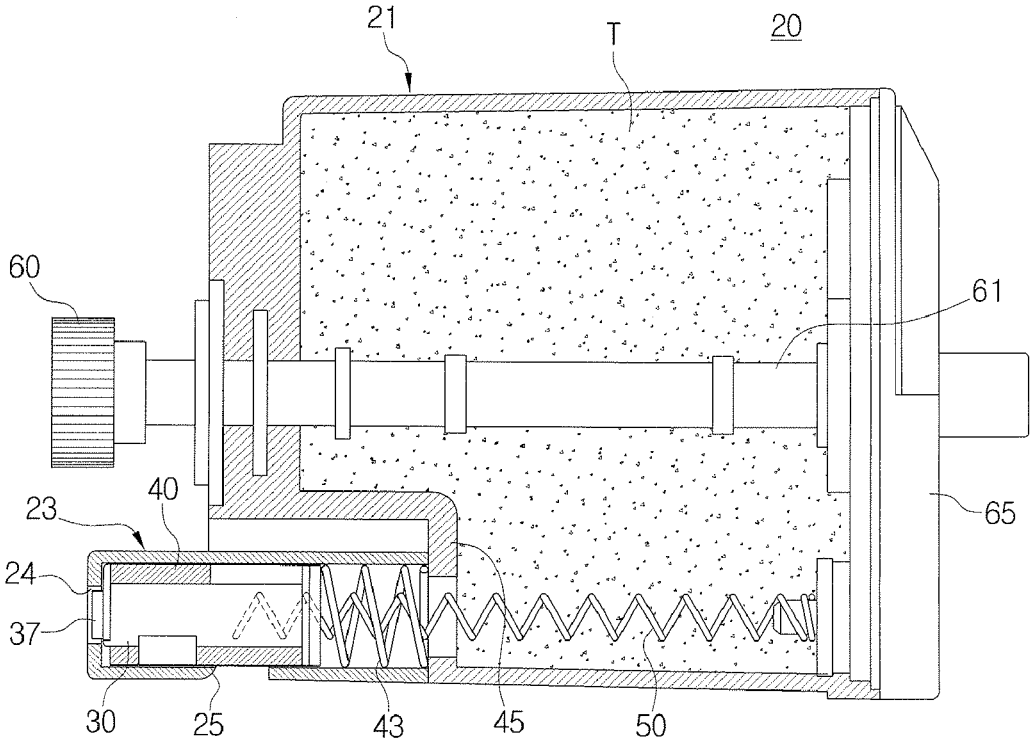
FIG. 2 is a sectional view illustrating a toner supplying apparatus according to an exemplary embodiment of the present general inventive concept.

Referring to FIG. 2, a toner supplying apparatus 20 according to an exemplary embodiment of the present general inventive concept may include a toner tank 21, a supplying part 23, a slide shutter 30, a sealing member 40, a toner conveying member 50, a driving gear 60, and a power transmission member 65.

The toner tank 21 may store a toner T, and may include a toner supplying hole 25 to discharge the toner T on one side thereof. The toner tank 21 may be formed in a substantially hollow cylindrical shape, and store the toner T inside.

Figure 6:
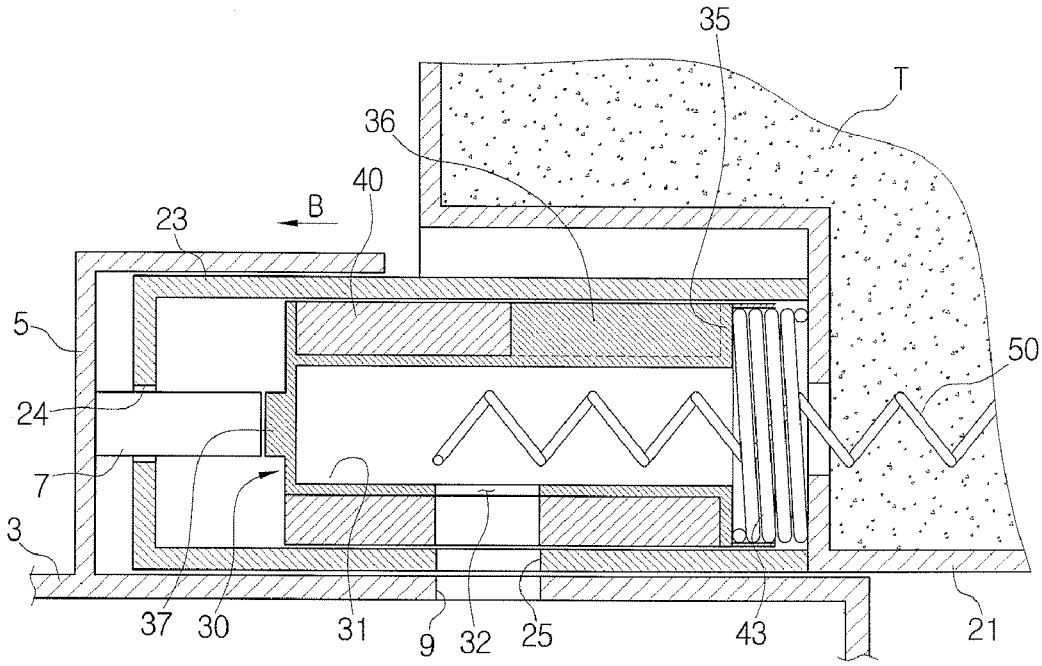
FIG. 6 is a partial sectional view illustrating a slide shutter of the toner supplying apparatus of FIG. 2 when mounted in an image forming apparatus.

The supplying part 23 may be formed in a substantially hollow cylindrical shape having a small outer diameter so as to be disposed inside the toner tank 21, and may be disposed inside the toner supplying hole 25. A portion of the toner tank 21 in which the toner supplying hole 25 is disposed forms a portion of walls constituting the supplying part 23. Accordingly, the toner supplying hole 25 is separated from the space of the toner tank 21 in which the toner T is stored by the supplying part 23. Additionally, the supplying part 23 may be formed so that a leading end part thereof can protrude to the outside of the toner tank 21, as illustrated in FIG. 2. An opening 24 into which an operating projection 7 of an image forming apparatus 3 as illustrated in FIG. 6 is inserted may be formed at the leading end part of the supplying part 23.

The slide shutter 30 may be disposed inside the supplying part 23, and may slide to the left or right along the supplying part 23 to selectively open or seal the toner supplying hole 25. In other words, if the toner supplying apparatus 20 is mounted in the image forming apparatus 3 (referring to FIG. 6), the slide shutter 30 may open the toner supplying hole 25, and if the toner supplying apparatus 20 is separated from the image forming apparatus 3 (referring to FIG. 5), the slide shutter 30 may close the toner supplying hole 25. Additionally, the sealing member 40 may be disposed on an outer circumference of the slide shutter 30.

Figure 3:
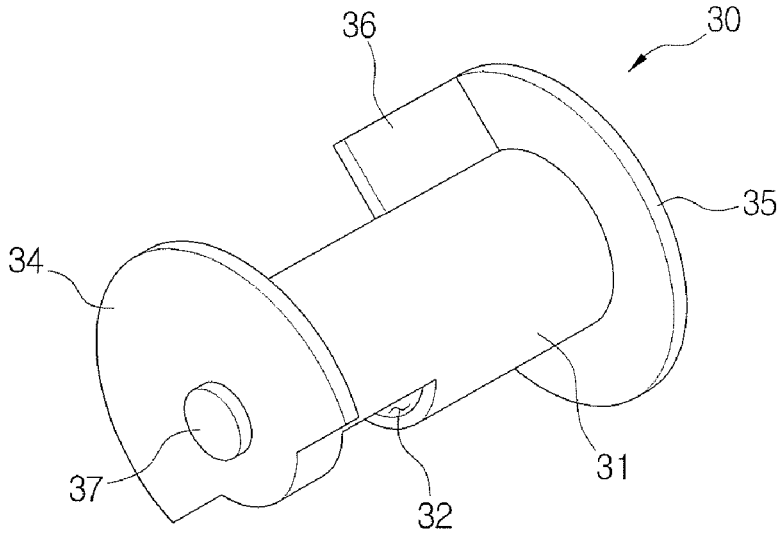
FIG. 3 is a perspective view illustrating a slide shutter of the toner supplying apparatus of FIG. 2, according to an exemplary embodiment of the present general inventive concept.
Figure 4:
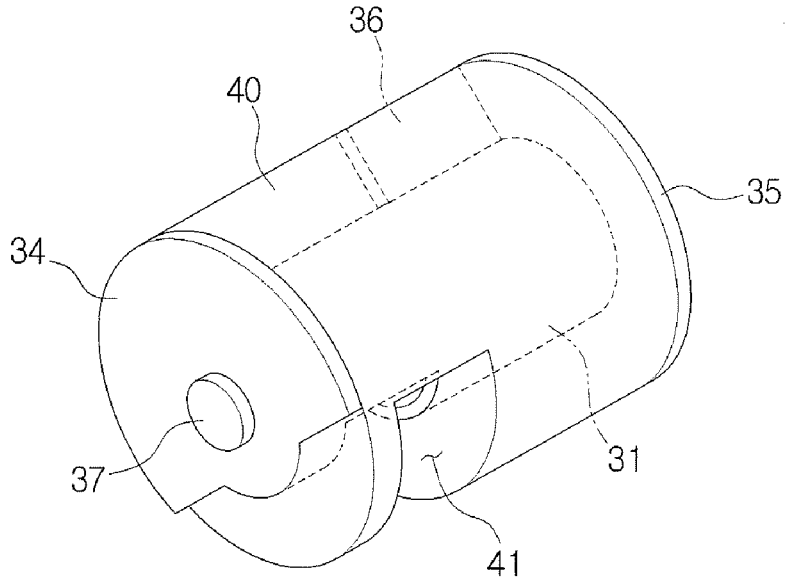
FIG. 4 is a perspective view illustrating a sealing member disposed in the slide shutter of FIG. 3, according to an exemplary embodiment of the present general inventive concept.

Referring to FIG. 3, the slide shutter 30 may include a body part 31 which is formed in a substantially hollow cylindrical shape to permit passage of the toner therethrough, and a front circular plate 34 and a rear circular plate 35 which are formed at both ends of the body part 31 and have an outer diameter corresponding to an inner diameter of the supplying part 23. The body part 31 may include a toner outlet 32 facing the toner supplying hole 25 to discharge toner. The front and rear circular plates 34 and 35 may guide the slide shutter 30 to slide along the supplying part 23, and serve to fix the sealing member 40. In this situation, a portion of the front circular plate 34 may be cut, if needed (referring to FIG. 3). The sealing member 40 may be disposed on an outer surface of the body part 31 between the front and rear circular plates 34 and 35. An outer circumference of the sealing member 40 may be formed in a substantially cylindrical shape corresponding to the inner surface of the supplying part 23, and an inner circumference of the sealing member 40 may be formed in a shape corresponding to the body part 31 of the slide shutter 30. Additionally, the sealing member 40 may include an opening 41 corresponding to the toner outlet 32 of the slide shutter 30. The sealing member 40 may be molded of a material which enables the slide shutter 30 to slide easily relative to the supplying part 23 while preventing toner from flowing into the supplying part 23. In an exemplary embodiment of the present general inventive concept, the sealing member 40 may be molded using a sponge. Additionally, in order to securely fix the sealing member 40 and guide the slide shutter 30 to easily slide, the slide shutter 30 may further include a guide part 36 as illustrated in FIG. 3. The guide part 36 may be disposed on an outer circumference of the body part 31 and have a length equal to approximately half the length of the body part 31. FIG. 4 illustrates the slide shutter 30 in which the sealing member 40 is disposed. The slide shutter 30 may further include a head part 37. The head part 37 may be formed on the front circular plate 34 so as to accommodate the operating projection 7 (referring to FIG. 6) which is formed on the fixing part 5 (referring to FIG. 6) of the image forming apparatus 3 (referring to FIG. 6). Accordingly, if the supplying part 23 of the toner supplying apparatus 20 is inserted into the fixing part 5, the head part 37 may be in contact with the operating projection 7 to push the slide shutter 30 back. The slide shutter 30 and sealing member 40 illustrated in FIGS. 3 and 4 are merely exemplary, and accordingly may be molded in various shapes so that the slide shutter 30 can slide to the left or right along the supplying part 23 while selectively opening and closing the toner supplying hole 25.

The slide shutter 30 may be elastically supported by an elastic member 43 disposed at the rear circular plate 35. The elastic member 43 may be fixed on a partition wall 45 which is disposed inside the toner tank 21. Accordingly, if the toner supplying apparatus 20 is mounted in the image forming apparatus 3, the slide shutter 30 may open the toner supplying hole 25 while being pushed back by the operating projection 7, and if the toner supplying apparatus 20 is separated from the image forming apparatus 3, the slide shutter 30 may be returned to an original position by the elastic member 43 and seal the toner supplying hole 25. A coil spring having an outer diameter corresponding to a diameter of the rear circular plate 35 of the slide shutter 30 may be used as an elastic member 43 so that the toner conveying member 50 can be disposed inside the elastic member 43.

The toner conveying member 50 may extend from a lower part of the inside of the toner tank 21 to the inside of the slide shutter 30 to reach the toner supplying hole 25, and may be formed in a coil spring shape. Therefore, if the toner conveying member 50 rotates, the toner stored in the toner tank 21 may be conveyed to the inside of the slide shutter 30. One end of the toner-conveying member 50 may be connected to the power transmission member 65 which is disposed on one side of the toner tank 21. The power transmission member 65 may receive power from the driving gear 60 to rotate the toner conveying member 50. Various types of power transmission means can be used as a power transmission member 65, and the power transmission member 65 may comprise a gear train.

The driving gear 60 may be disposed on one side of the toner tank 21, and if the toner supplying apparatus 20 is mounted in the image forming apparatus 3, power may be supplied from the image forming apparatus 3 to the driving gear 60. Additionally, the driving gear 60 may be connected to the power transmission member 65 through a driving shaft 61 which penetrates the toner tank 21. Accordingly, if the driving gear 60 rotates, power may be transferred to the power transmission member 65. The driving shaft 61 may further include an agitating member (not illustrated) capable of agitating the toner T stored in the toner tank 21.

Hereinafter, an operation of the toner supplying apparatus 20 according to an exemplary embodiment of the present general inventive concept will be described in detail with reference to FIGS. 2, 5, and 6.

Figure 5:
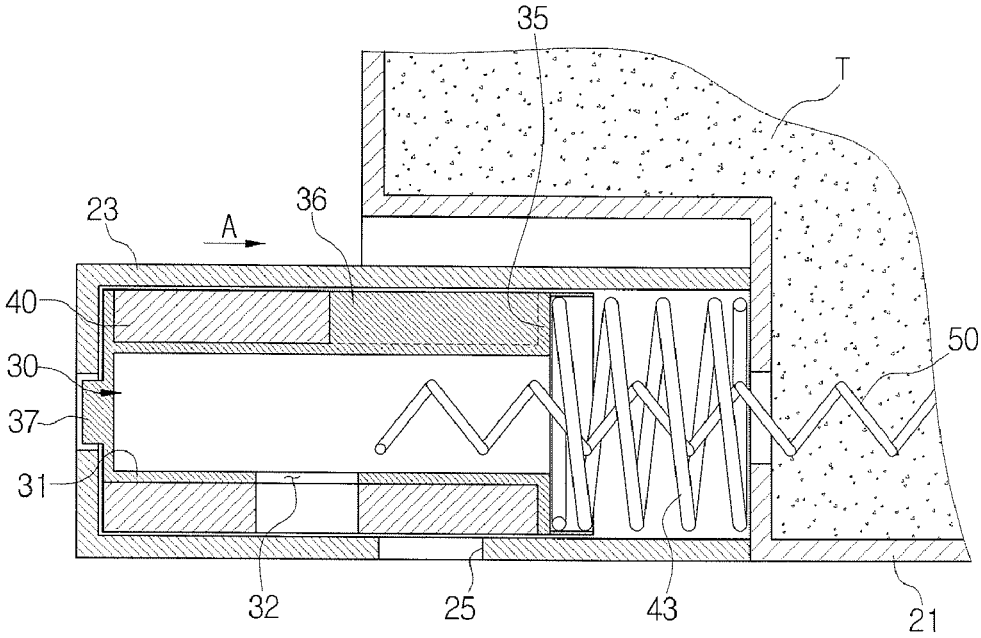
FIG. 5 is a partial sectional view illustrating a slide shutter of the toner supplying apparatus of FIG. 2 when separated from an image forming apparatus.

When the toner supplying apparatus 20 is separated from the image forming apparatus 3, the slide shutter 30 seals the toner supplying hole 25 of the toner tank 21, as illustrated in FIGS. 2 and 5. Specifically, the sealing member 40 disposed on the slide shutter 30 currently closes the toner supplying hole 25. The sealing member 40 is in close contact with the inner surface of the supplying part 23, and thus it is possible to prevent the toner T from leaking out of the toner supplying hole 25 through a gap between the slide shutter 30 and the toner tank 21 when transporting the toner supplying apparatus 20.

The fixing part 5 may be formed in the image forming apparatus 3 to enable the toner supplying apparatus 20 to be mounted in the image forming apparatus 3. The fixing part 5 may include a toner inlet 9 facing the toner supplying hole 25, and the toner inlet 9 may be connected to a developing unit (not illustrated) of the image forming apparatus 3. Accordingly, the toner flowing into the toner inlet 9 may flow to the developing unit, and an electrostatic latent image may be developed to form an image.

If the toner supplying apparatus 20 is mounted on the fixing part 5 of the image forming apparatus 3, the toner supplying hole 25 of the toner supplying apparatus 20 may face the toner inlet 9 of the fixing part 5. The operating projection 7 formed inside the fixing part 5 may push the head part 37 of the slide shutter 30 back (indicated by arrow A in FIG. 5). Accordingly, the toner outlet 32 of the slide shutter 30 may face the toner supplying hole 25 of the toner tank 21, and the toner supplying hole 25 may be opened. In other words, the toner outlet 32 of the slide shutter 30, the toner supplying hole 25 of the toner tank 21, and the toner inlet 9 of the fixing part 5 may be in fluid communication with each other.

If the toner supplying apparatus 20 is mounted in the image forming apparatus 3, the driving gear 60 may rotate by the power transferred from a driving source (not illustrated) of the image forming apparatus 3. Therefore, the toner conveying member 50 may rotate using the power transferred from the driving gear 60 through the driving shaft 61 and the power transmission member 65.

Accordingly, if the slide shutter 30 slides to open the toner supplying hole 25, the toner T stored in the toner tank 21 may continuously flow to the toner outlet 32 of the slide shutter 30 by the rotation of the toner conveying member 50, and the toner T discharged through the toner outlet 32 may be supplied to the toner inlet 9 of the image forming apparatus 3 through the toner supplying hole 25. Toner T falling into the toner inlet 9 may be conveyed to the developing unit (not illustrated) of the image forming apparatus 3 by a toner conveying means (not illustrated) to form an image.

If the toner T in the toner tank 21 runs out, the toner supplying apparatus 20 may be separated from the image forming apparatus 3 in order to exchange the toner supplying apparatus 20 or fill the toner tank 21 with toner T. If the supplying part 23 of the toner supplying apparatus 20 is separated from the fixing part 5 of the image forming apparatus 3, the slide shutter 30 may move in a direction indicated by arrow B in FIG. 6 and be returned to the original position by the elastic member 43 that has been pushed. If the slide shutter 30 returns to the original position, the sealing member 40 may seal the toner supplying hole 25 of the toner tank 21, as illustrated in FIG. 5. The sealing member 40 may be in close contact with the inner surface of the supplying part 23, so it is impossible for the toner T to penetrate into a space between the sealing member 40 and the inner surface of the supplying part 23. Accordingly, the slide shutter 30 may slide without being affected by the toner T, and there is no situation in which the toner T remaining in the toner tank 21 leaks out of the toner tank 21 through the toner supplying hole 25. In addition, if the toner supplying apparatus 20 is separated from the image forming apparatus 3, power transmission to the driving gear 60 may be blocked, and thus it is impossible to rotate the toner conveying member 50.

As described above, in the toner supplying apparatus according to the exemplary embodiment of the present general inventive concept, the sealing member is disposed on the outer circumference of the slide shutter, and therefore it is possible to prevent the leak of the toner stored in the toner supplying apparatus when the toner supplying apparatus is attached to or detached from the image forming apparatus or when transporting the toner supplying apparatus.

Additionally, the sealing member may prevent the toner from penetrating into a space between the slide shutter and the supplying part and attaching to the outer circumference of the slide shutter, so the toner supplying hole may be easily opened and closed by the slide shutter when the toner supplying apparatus is attached to or detached from the image forming apparatus.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A toner supplying apparatus comprising:

a toner tank to hold toner, the toner tank having a toner supplying opening to discharge the toner;

a slide shutter disposed inside the toner tank so as to close the toner supplying opening, the slide shutter allowing the toner supplying opening to be opened when the toner tank is mounted in an image forming apparatus;

a sealing member disposed on an outer circumference of the slide shutter and moving along with the slider shutter to prevent the toner from leaking out through a gap between the slide shutter and the toner tank;

a supplying part formed in a substantially cylindrical shape to guide movement of the slide shutter; and an elastic member to elastically support the slide shutter.

2. The apparatus as claimed in claim 1, wherein the slide shutter comprises:

a body part formed in a substantially hollow cylindrical shape, the body part comprising a toner outlet; and a front circular plate and a rear circular plate disposed at both ends of the body part, the front and rear circular plates having outer diameters corresponding to an inner diameter of the supplying part.

3. The apparatus as claimed in claim 2, wherein the slide shutter further comprises:

a guide part disposed on an outer circumference of the body part.

4. A toner supplying apparatus comprising:

a toner tank to hold toner, the toner tank communicating with a toner supplying opening to discharge the toner;

a supplying part formed with the toner tank in a substantially hollow cylindrical shape such that the toner supplying opening is separated from the toner tank in which the toner is stored;

a slide shutter disposed inside the supplying part to close the toner supplying opening, the slide shutter allowing the toner supplying opening to be opened when the toner tank is mounted in an image forming apparatus;

an elastic member to elastically support the slide shutter so that the slide shutter returns to an original position to seal the toner supplying opening when the toner tank is removed from the image forming apparatus;

a toner conveying member extending from the inside of the toner tank to the inside of the slide shutter to convey the toner stored in the toner tank to the toner supplying opening; and a sealing member disposed on an outer circumference of the slide shutter and moving together with the slide shutter to prevent the toner from leaking out through a gap between the slide shutter and the supplying part.

5. A toner tank of a toner supplying apparatus detachably mounted in an image forming apparatus to supply toner, comprising:

a supplying part to guide a slide shutter having a sealing member on an outer circumference thereof to slide along an inside surface of the supplying part; and a toner supplying opening formed in the supplying part to discharge toner stored in the toner tank, wherein the sealing member of the slide shutter seals the toner supplying opening when the toner supplying apparatus is removed from the image forming apparatus, and wherein an elastic member to elastically support the slide shutter is disposed in the toner tank.

6. A slide shutter of a toner supplying apparatus detachably mounted in an image forming apparatus to supply toner, characterized in that the toner supplying apparatus comprises a supplying part in which a toner supplying opening to discharge toner is formed, wherein the slide shutter comprises a body part formed in a substantially hollow cylindrical shape, the body part having a toner outlet, and a front circular plate and a rear circular plate disposed at both ends of the body part, the front and rear circular plates having outer diameters corresponding to an inner diameter of the supplying part, and wherein the toner outlet faces the toner supplying opening of the supplying part when the toner supplying apparatus is mounted in the image forming apparatus.

7. The slide shutter as claimed in claim 6, wherein a sealing member is disposed on the body part to prevent the toner from leaking out through a gap between the slide shutter and the supplying part.

8. The slide shutter as claimed in claim 7, wherein an elastic member is disposed inside the supplying part to elastically support the slide shutter.

9. The slide shutter as claimed in claim 7, further comprising:

a guide part disposed on an outer circumference of the body part.

10. A sealing member of a toner supplying apparatus detachably mounted in an image forming apparatus to supply toner, characterized in that the toner supplying apparatus comprises a supplying part in which a toner supplying opening to discharge toner is formed, and the sealing member, disposed on an outer circumference of a slide shutter to slide inside the supplying part, to allow the toner of the toner supplying apparatus to be discharged to the image forming apparatus when a toner outlet of the slide shutter faces the toner supplying opening, and to prevent the toner from leaking out through a gap between the supplying part and the slide shutter when the toner outlet of the slide shutter is not positioned over the toner supplying opening.

11. An elastic member of a toner supplying apparatus detachably mounted in an image forming apparatus to supply toner, characterized in that the toner supplying apparatus comprises a supplying part in which a toner supplying opening to discharge toner is formed, and the elastic member, disposed inside the supplying part to elastically support a slide shutter, to enable a toner outlet of the slide shutter to face the toner supplying opening when the toner supplying apparatus is mounted in the image forming apparatus, and to enable a sealing member disposed on an outer circumference of the slide shutter to seal the toner supplying opening when the toner supplying apparatus is removed from the image forming apparatus.

12. A toner supplying apparatus comprising:

a toner tank to hold toner, the toner tank having a toner supplying opening to discharge the toner;

a slide shutter disposed inside the toner tank so as to close the toner supplying opening, the slide shutter allowing the toner supplying opening to be opened when the toner tank is mounted in an image forming apparatus;

a sealing member disposed on an outer circumference of the slide shutter to prevent the toner from leaking out through a gap between the slide shutter and the toner tank;

a supplying part formed in a substantially cylindrical shape to guide movement of the slide shutter; and an elastic member to elastically support the slide shutter, wherein the slide shutter comprises:

a body part formed in a substantially hollow cylindrical shape, the body part comprising a toner outlet; and a front circular plate and a rear circular plate disposed at both ends of the body part, the front and rear circular plates having outer diameters corresponding to an inner diameter of the supplying part.

13. A toner supplying apparatus comprising:

a toner tank to hold toner, the toner tank having a toner supplying opening to discharge the toner;

a supplying part formed with the toner tank in a substantially hollow cylindrical shape such that the toner supplying opening is separated from the toner tank in which the toner is stored; a slide shutter disposed inside the supplying part to close the toner supplying opening, the slide shutter allowing the toner supplying opening to be opened when the toner tank is mounted in an image forming apparatus;

an elastic member to elastically support the slide shutter so that the slide shutter returns to an original position to seal the toner supplying opening when the toner tank is removed from the image forming apparatus;

a toner conveying member extending from the inside of the toner tank to the inside of the slide shutter to convey the toner stored in the toner tank to the toner supplying opening; and a sealing member disposed on an outer circumference of the slide shutter to prevent the toner from leaking out through a gap between the slide shutter and the supplying part, wherein the slide shutter comprises:

a body part formed in a substantially hollow cylindrical shape, the body part comprising a toner outlet; and a front circular plate and a rear circular plate disposed at both ends of the body part, the front and rear circular plates having outer diameters corresponding to an inner diameter of the supplying part.

14. A toner tank of a toner supplying apparatus detachably mounted in an image forming apparatus to supply toner, comprising:

a supplying part to guide a slide shutter having a sealing member on an outer circumference thereof to slide along an inside surface of the supplying part; and a toner supplying opening formed in the supplying part to discharge toner stored in the toner tank, wherein the slide shutter comprises a body part formed in a substantially hollow cylindrical shape, the body part having a toner outlet, and a front circular plate and a rear circular plate disposed at both ends of the body part, the front and rear circular plates having outer diameters corresponding to an inner diameter of the supplying part, and wherein the sealing member of the slide shutter seals the toner supplying opening when the toner supplying apparatus is removed from the image forming apparatus.

* * * * *